United States Patent [19]

Christoffel, Jr.

[11] 3,967,798

[45] July 6, 1976

[54] BOX-LIKE KITE

[75] Inventor: Julius M. Christoffel, Jr., Houston, Tex.

[73] Assignee: Gayla Industries, Inc., Houston, Tex.

[22] Filed: Apr. 3, 1975

[21] Appl. No.: 564,830

Related U.S. Application Data

[63] Continuation of Ser. No. 389,867, Aug. 20, 1973, abandoned.

[52] U.S. Cl. ..... 244/153 R; D34/15 AF

[51] Int. Cl.[2] ..... B64C 31/06

[58] Field of Search ..... 244/153 R, DIG. 1, 154; 46/74 R, 79; D34/15 AF

[56] References Cited

UNITED STATES PATENTS

| | | | |
|---|---|---|---|
| 2,386,762 | 10/1945 | Wheelwright | 244/153 R |
| 2,434,077 | 1/1948 | Lang | 244/153 R |
| 2,783,958 | 3/1957 | Caroff | 244/153 R |
| 2,812,914 | 11/1957 | Williams | 244/154 |
| 2,927,752 | 3/1960 | Jordan | 244/153 R |
| 3,007,659 | 11/1961 | Zachary | 244/153 R |
| 3,107,888 | 10/1963 | Finn | 244/153 A |
| 3,187,460 | 6/1965 | Robertson | 46/79 |
| 3,194,520 | 7/1965 | Kurjian | 244/153 R |
| D189,458 | 12/1960 | Jordan | D34/15 AF |

*Primary Examiner*—Trygve M. Blix
*Assistant Examiner*—Barry L. Kelmachter
*Attorney, Agent, or Firm*—Bard, Springs & Jackson

[57] ABSTRACT

A box-like kite formed of a single strut on which a pair of airfoils are pivotally connected in spaced relation. Each airfoil is constructed of a rectangular sheet of formed plastic folded into a generally triangular, hollow, open-ended box having curved walls.

14 Claims, 7 Drawing Figures

FIG. 1
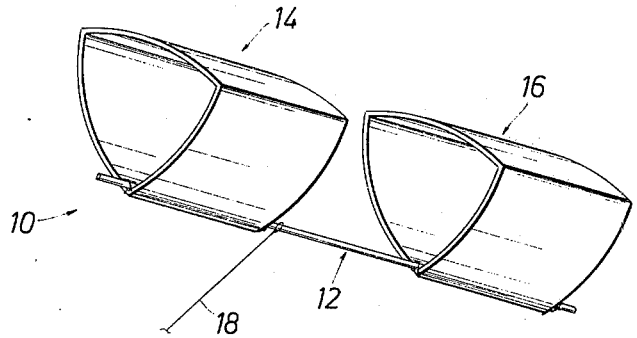
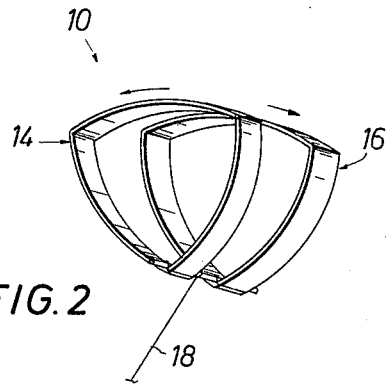
FIG. 2
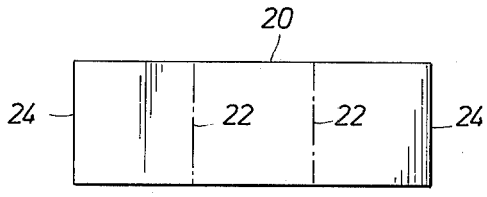
FIG. 3
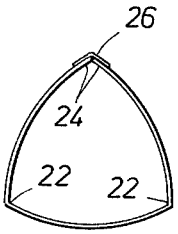
FIG. 4
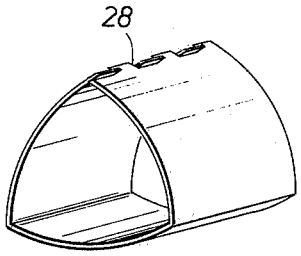
FIG. 5
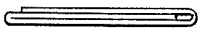
FIG. 6
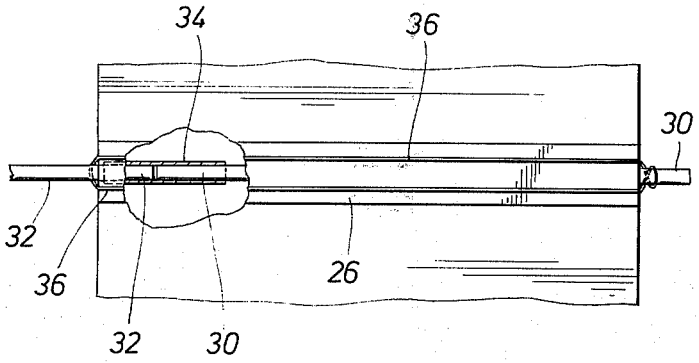
FIG. 7

BOX-LIKE KITE

This is a continuation of application Ser. No. 389,867, filed Aug. 20, 1973, now abandoned.

BACKGROUND OF INVENTION

1. Field of the Invention

This invention relates generally to kites and more particularly to an improved, novel, box-like kite.

2. Brief Description of the Prior Art

One popular form of kite is the box kite which is formed of an open framework of struts having each quarter end section covered with a band of material. The framework of a box kite is always rigid and has internal bracing to keep the kite from collapsing during flight. Although the most familiar shape for a box kite is the oblong box with a square cross section, the cross sectional configuration of a box kite may be a triangle or any other polygon, including round shapes such as a circle, oval or ellipse.

The box kite, being three dimensional, acts like an airfoil, and it is normally a good flyer. Each covered surface acts as an opposing force to the wind. If the wind blows too hard against one surface, another side of the box kite gradually swings around, and the kite is steadied. If the kite string or bridle is attached to one strut, the surfaces extending therefrom provide a dihedral angle which will improve lateral and directional stability and will assist the box kite in maintaining its stabilized flight attitude. Accordingly, the box kite does not normally need or utilize a tail.

However, if a box kite is flown in erratic winds, it may be difficult to control since if one of the covered end sections is hit by a cross wind the box kite may keel over. Once a box kite starts to keel over, it tends to remain on such course and it is very difficult to restabilize the kite to normal flight attitude.

Although the box kite has some excellent flying characteristics, it is difficult to mass produce; it usually forms a fairly long package which is susceptible to damage in shipping, and, due to complex internal bracing, it is difficult to assemble.

SUMMARY OF THE INVENTION

To overcome the disadvantages of prior art box kites, the present invention provides a novel box-like kite which is provided with means to automatically restabilize it to proper flying attitude and which is so designed that it may be formed into a small, durable package. The kite is comprised of a single strut to which a plurality of spaced airfoils are pivotally connected. Each airfoil is a hollow, open-ended box which may be formed from a rectangular sheet of foamed plastic having fold lines to facilitate folding it into the desired airfoil shape. The box airfoil may have a triangular cross section, as shown in the preferred embodiment, or it may have any other closed geometrical cross section. Also, the walls of the airfoils may be curved, either convexly or concavely, about their longitudinal axes.

By folding each sheet of foamed plastic over on itself and forming the strut from several short lengths of rod which are attached together by connecting sleeves, the disassembled kite may be formed into a compact and durable package.

To assemble the kite, the folded plastic sheet is bent into its predetermined airfoil shape and the abutting ends secured together. The strut is assembled and the box airfoil is slipped over the end thereof and then properly positioned and pivotally connected thereto. To form the pivotal connection, a rubber band may be positioned on the strut adjacent one end of the airfoil, extended along the length of the airfoil and then attached by a double loop to the strut adjacent the other end of the airfoil. Such construction also maintains the airfoils in proper spaced relation along the strut. By having the connecting sleeves underneath the airfoils, tension tending to separate the strut is eliminated.

In flight, if an erratic wind hits the kite and keels it over in one direction, the rear airfoil being pivotally connected will automatically swing in the opposite direction and guide the kite such as a rudder would do until the kite regains proper flying attitude.

It is an object of the present invention to provide a novel box-like kite provided with swinging airfoil means which will automatically restabilize the kite to proper flight attitude should it start to keel over.

It is another object to provide a novel box kite having a plurality of spaced box airfoils in which one of the box airfoils responds as an automatic stabilizer, thereby providing stabilizing action without any weight penalty therefor.

It is a further object to provide a novel box kite which will maintain stable flight attitude even in erratic winds.

It is still a further object to provides a novel box kite which is amenable to mass production, easy to package, and simple to assemble.

Other objects and many of the attendant advantages of this invention will be readily appreciated to those skilled in the art from consideration of this specification, including the accompanying drawings.

BRIEF DESCRIPTION OF THE DRAWINGS

FIG. 1 is a pictorial view of the kite of the present invention in normal flight.

FIG. 2 is a view similar to FIG. 1 illustrating the automatic stabilizing effect of the rear airfoil.

FIG. 3 is a plan view of sheet from which the airfoil may be formed.

FIG. 4 is an end view illustrating the box airfoil formed from folding the sheet shown in FIG. 2 into the desired airfoil shape.

FIG. 5 is a pictorial view illustrating an alternate means for securing the abutting ends of the airfoil.

FIG. 6 is an end view illustrating the sheet for forming the airfoil folded for packaging.

FIG. 7 is a plan view illustrating the sleeve connection for joining the strut and the pivotal connection of an airfoil to the strut.

DETAILED DESCRIPTION OF THE SPECIFIC EMBODIMENT

Reference will now be made to FIG. 1 which illustrates a box kite 10 of the present invention in flight. As can be seen, kite 10 only has a single strut 12 to which a pair of box-like airfoils 14–16 are pivotally connected. A tethering string 18 is secured to strut 12 adjacent upper airfoil 14. If desired, a bridle may be used to attach string 18 to the kite.

Each airfoil may be formed from a light, strong, rigid, flexible material which is capable of being folded to a desired shape and which has sufficient rigidity and strength to withstand the buffeting that a kite receives. One such material is a foamed plastic known as expanded styrene. If airfoils are formed from expanded styrene which comes in rolls, the material may be cut into rectangular sheets 20 and provided with scorelines 22—22 intermediate ends 24—24 (see FIG. 3). The sheet 20 may be folded over on itself to form a small unit for packaging of the kite (see FIG. 6). To form the box-like airfoil, sheet 20 is bent at scorelines 22—22 into the desired configuration, such as a triangular, hollow, open-ended polyhedron; the walls thereof may be curved along their longitudinal axes (see FIG. 4). The abutting ends 24—24 may be detachably secured together by a length of sealing tape (see FIG. 4), or each end may be provided with a set of mating notches 28 and the notches latched together as seen in FIG. 5.

It has been determined that expanded styrene formed into a hollow, open-ended polyhedron having triangular cross section with curved walls makes an excellent airfoil for the kite. Such an airfoil is light but strong. With such material and configuration there is an excellent lift-to-weight ratio, and the airfoil has good aerodynamic characteristics. The airfoil is easy to manufacture, folds into small unit for shipping and merchandising, and is easy for even a youngster to assemble. The assembled box-like airfoil is easy to pivotally attach to the strut. If desired, the hollow, open-ended box airfoil may be formed of other light, strong material, such as corrugated board or balsam wood.

While the strut 12 may be a single member, it may also be formed of a plurality of short lengths 30 joined together by connecting sleeves 34 as can be seen in FIG. 7. With such construction the disassembled kite will form a package which will endure the normal rigors of shipping and which is sufficiently compact for merchandising purposes.

To assemble the kite, the short lengths of rod are secured together by connecting sleeves 34 to form full length strut 12. If desired, members 30—30 forming the end sections of strut 12 may be shorter than member 32 which forms the center section, whereby each connecting sleeve 34 will be located underneath an airfoil (see FIG. 7). Sheet 20 is bent along fold lines 22—22 into its predetermined airfoil shape and ends 24—24 secured together by tape 26 to form the pivotal connection. A rubber band 36 is positioned on strut 12 just inboard of connecting sleeve 34. The hollow, box-like airfoil is slipped over the end of the strut and positioned adjacent rubber band 36. The free end of rubber band 36 is extended outward along the length of the airfoil and secured to the strut adjacent the outboard end of the airfoil by a double loop. The double loop provides sufficient frictional restraint to maintain the airfoils in proper spaced relation along the length of strut 12. By simply placing the rubber band around the strut, stretching it along the length of the airfoil and then securing it with a double loop, the two strands of rubber band 36 form parallel tracks along the length of the airfoil (see FIG. 7), eliminating any binding of the pivotal connection, thereby allowing each airfoil to swing freely about the axis of strut 12. By having each connecting sleeve 34 located underneath an airfoil, the tendency for the joints of strut 12 to separate is virtually eliminated. Being so located, there are no opposing forces tending to pull the joints apart. Further, stretched rubber band 36 exerts sufficient force to maintain the joint located between its ends tight.

In normal flight, airfoils 14–16 are aligned, as can be seen in FIG. 1; however, if an erratic wind should hit the kite and start it to keel over, rear airfoil 16 will automatically swing in the opposite direction from forward airfoil 14 (see FIG. 2) and, acting as a rudder stabilizer, will properly guide the kite until the kite regains normal flight attitude. Accordingly, rear airfoil 16 not only acts to provide lifting surface during flight but also automatically responds as a swinging stabilizer to reorient the kite should it be hit by cross winds.

From the foregoing discussion, examples and description of the invention, it is apparent that the objects set forth herein as well as others have been achieved. Those skilled in the art will recognize that the principles of this invention may be applied in several ways, only a few of which have been exemplified herein specifically.

Accordingly, the invention is to be limited only by the spirit hereof and the scope of the appended claims.

What is claimed is:

1. A box-like kite comprising:

a single strut-like member, a plurality of hollow, open-ended box-like airfoil members having a single, continuous side wall extending longitudinally along the strut-like member, and means separately and independently pivotally connecting each airfoil member to the strut-like member, said connecting means being formed by the side wall being adjacent to the strut-like member and a member cooperating with the side wall and the strut-like member to pivotally attach the airfoil member to the strut-like member in spaced apart relation whereby each airfoil member may freely move about its pivot and rotate relative to the other airfoil member to stabilize the flight of the kite.

2. The kite specified in claim 1 in which each hollow, open-ended box-like airfoil member has three sides.

3. The kite specified in claim 2 in which the walls of the airfoil member are curved about their longitudinal axes.

4. The kite specified in claim 2 in which the airfoil member is constructed from a rectangular sheet of foamed plastic having two scorelines intermediate the ends along which the sheet is folded, the ends of the sheet being secured together to form a triangular polyhedron.

5. The kite specified in claim 1 in which the strut-like member is formed of a plurality of sections joined together by connecting sleeves, the sleeves being located under the airfoil members; and means exerting a force in tension to the strut-like member on each side of the sleeve to maintain the strut-like tight.

6. The kite specified in claim 5 in which the means applying tension to the strut-like member is a rubber band attached to the strut-like member adjacent each end of the airfoil member and extends along the length of the side wall thereof, said member also forming the pivotal attachment for the airfoil member.

7. The kite specified in claim 1 in which each airfoil member is constructed of a rectangular sheet of foamed plastic having sufficient rigidity to maintain a predetermined shape, the sheet having a plurality of scorelines intermediate the ends, the sheet being folded along the scorelines and the two ends being secured together.

8. The kite specified in claim 7 in which each end of the sheet is provided with a set of notches and the two sets of notches are joined together to secure the ends.

9. A box-like kite comprising:

a single strut, a pair of airfoils, each airfoil being a hollow, open-ended, triangular polyhedron extending longitudinally along the strut in spaced apart relation, and a pivotal connection for each airfoil formed by the strut extending along the inner wall of one corner of the airfoil and a rubber band extending along the length of the outer wall of the airfoil and attached to the strut adjacent to each end of the airfoil whereby one airfoil may rotate relative to the other to stabilize the flight of the kite.

10. The kite specified in claim 9 in which the airfoil is formed of a rectangular sheet of foamed plastic having a pair of scorelines along which the sheet is folded with the two ends being secured together to the triangular polyhedron.

11. The kite specified in claim 10 in which the walls of the airfoils are convexly curved along their longitudinal axes.

12. The kite specified in claim 9 in which the strut is formed of three sections of rod which are detachably joined together by connecting sleeves, the sleeves being located underneath the airfoil, whereby the rubber band exerts a force maintaining the joint tight.

13. A box-like kite comprising:

a single strut-like member, a plurality of hollow, open-ended box-like airfoil members extending longitudinally along the strut-like member in spaced apart relation, and means separately and independently pivotally connecting each airfoil member to the strut-like member, said pivotal means formed by an airfoil member being slipped over the strut-like member, and a rubber band having one end looped over the strut-like member is positioned adjacent to one end of the airfoil member, the rubber band extending along the length of the airfoil member and having its other end attached to the strut-like member adjacent to the other end of the airfoil member whereby one airfoil member may move relative to another to stabilize the flight of the kite.

14. The kite specified in claim 13 in which the strut-like member is formed of a plurality of sections which are detachably joined together by connecting sleeves.

* * * * *

UNITED STATES PATENT OFFICE
CERTIFICATE OF CORRECTION

Patent No. 3,967,798 Dated July 6, 1976

Inventor(s) Julius M. Christoffel, Jr.

It is certified that error appears in the above-identified patent and that said Letters Patent are hereby corrected as shown below:

In the ABSTRACT, line, 4, "formed" should read --foamed--.

Col. 2, line 27, "provides" should read --provide--.

Col. 2, line 31, "to" should read --by--.

Col. 4, line 49, "strut-like" should read --sleeve--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*